US012241271B1

(12) United States Patent
Shen

(10) Patent No.: US 12,241,271 B1
(45) Date of Patent: Mar. 4, 2025

(54) CORD ADJUSTING ASSEMBLY

(71) Applicant: Long Xiang Shen, San Bernardino, CA (US)

(72) Inventor: Long Xiang Shen, San Bernardino, CA (US)

( * ) Notice: Subject to any disclaimer, the term of this patent is extended or adjusted under 35 U.S.C. 154(b) by 0 days.

(21) Appl. No.: 18/540,741

(22) Filed: Dec. 14, 2023

(51) Int. Cl.
*E04H 4/10* (2006.01)

(52) U.S. Cl.
CPC ..... *E04H 4/10* (2013.01)

(58) Field of Classification Search
CPC ..... E04H 4/10; B65H 75/406; Y10T 24/2164; F16G 11/12; B66D 1/04; B66D 1/06; B66D 1/34; B66D 3/02; B66D 3/026
USPC ..... 4/498, 502; 242/364, 378.1, 388, 388.1, 242/397, 564.2, 909; D12/183; 24/68 B, 24/68 R, 71.1, 132 R
See application file for complete search history.

(56) References Cited

U.S. PATENT DOCUMENTS 1,386,918 A * 8/1921 Westrup ..... B65H 75/406 411/530
2,319,731 A * 5/1943 Garrett ..... H02G 11/02 242/388
2,429,675 A * 10/1947 Eypper ..... H02G 11/02 242/601
2,597,351 A * 5/1952 MacKenzie ..... D06F 57/00 24/68 B
2,710,998 A * 6/1955 Meighan ..... B60P 7/083 242/388.2
4,390,142 A * 6/1983 Cheng ..... B65H 75/406 242/407
4,700,434 A * 10/1987 Fambrough ..... F16G 11/12 242/388.2
5,826,283 A * 10/1998 Edwards ..... E04H 4/10 4/503
D402,538 S * 12/1998 Wagter ..... D8/358
6,065,709 A * 5/2000 Wagter ..... B65H 75/406 242/405
10,473,418 B2 11/2019 Shaffer et al.
2006/0027697 A1* 2/2006 Gojanovic ..... B65H 75/4434 242/388.1
2012/0246818 A1* 10/2012 Dautrich ..... E04H 4/103 4/499
2017/0035210 A1* 2/2017 Nekhala ..... A47G 9/0246
2023/0270093 A1* 8/2023 Milton ..... A01K 89/0108 242/310

FOREIGN PATENT DOCUMENTS

DE 3336574 A1 * 4/1985 ..... B21F 9/00

OTHER PUBLICATIONS

DE3336574A1_Machine_Translation (Year: 2024).*

* cited by examiner

*Primary Examiner* — Erin Deery
*Assistant Examiner* — William R Klotz
(74) *Attorney, Agent, or Firm* — Ying-Ting Chen; Law Office of Michael Chen

(57) ABSTRACT

A cord adjusting assembly for a cover includes an affixing body including a front receiving slot and a rear receiving slot; a rotatable shaft coupled to the affixing body; a cord attached to the cover; wherein the front receiving slot, the rear receiving slot, and the rotatable shaft are cooperated with the cord to tighten or loosen the cord.

15 Claims, 5 Drawing Sheets

CORD ADJUSTING ASSEMBLY

FIELD OF THE DISCLOSURE

The present disclosure relates to an adjusting assembly, and more particularly to a cord adjusting assembly that can be used for a cover and/or a pool cover. It is particularly suitable for the cord adjusting assembly having an affixing body cooperated with a cord to selectively tighten or loosen the cord for selectively expanding or retracting the cover.

BACKGROUND OF THE DISCLOSURE

Generally, a winch body winch is a small tool that is used to help secure and loosen pool covers. They're similar to a simple crank or rachet. These winches are often referred to as cable tighteners in many pool cover manuals. They're usually made from heavy-duty metal that does not rust.

Currently, the pool cover comprises a winch body cooperated with a hand crank to tighten or loosen the cable selectively. For example, one end of the cable may pass through the winch body, and then the other end of the cable may also pass through the winch body. Furthermore, the hand crank is twisted to tighten the cable. However, the operator may have the hassle to pass through one end of the cable and also pass through the other end of the cable through the winch body. It may be time-consuming and inconvenient to pass one end of the cable and also pass the other end of the cable through the winch body.

Therefore, there may have a continuous need to develop a convenient way to tighten or loosen the cable coupled with the pool cover.

All referenced patents, applications and literature are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a cord adjusting assembly for a cover may comprise an affixing body comprising a front receiving slot and a rear receiving slot; a rotatable shaft coupled to the affixing body; a cord attached to the cover; wherein the front receiving slot, the rear receiving slot, and the rotatable shaft are cooperated with the cord to tighten or loosen the cord.

In another aspect combinable with the general implementation, the affixing body comprises a front wall and a rear wall located on an opposite side of the front wall, wherein the front receiving slot is formed on the front wall, and the rear receiving slot is formed on the rear wall.

Among the many possible implementations of the adjusting assembly, the affixing body may comprise a top wall and a bottom wall, wherein the rotatable shaft is passed through and rotated along the top wall and the bottom wall.

Further, it is contemplated that the affixing body may comprise a top wall and a bottom wall, wherein the top wall is formed on an opposite side of the bottom wall.

In the alternative, the front receiving slot may comprise a first front receiving slot formed on a bottom wall of the affixing body, and a second front receiving slot integrally extends from the first front receiving slot to form on a front wall.

It is still further contemplated that the rear receiving slot may comprise a first rear receiving slot formed on a top wall of the affixing body, and a second rear receiving slot integrally extends from the first rear receiving slot to form on a rear wall.

In another aspect combinable with the general implementation, the front receiving slot comprises a first front receiving slot formed on a bottom wall of the affixing body, wherein the first front receiving slot comprises an L-shaped configuration.

In another aspect combinable with the general implementation, the front receiving slot comprises a first front receiving slot formed on a bottom wall of the affixing body, wherein the first front receiving slot comprises a first receiving opening formed on a first front edge of the bottom wall.

In another aspect combinable with the general implementation, the front receiving slot comprises a first front receiving slot formed on a bottom wall of the affixing body, wherein the first front receiving slot upwardly extends to form a second front receiving slot, wherein the second front receiving slot has an L-shaped configuration.

In another aspect combinable with the general implementation, the rear receiving slot comprises a first rear receiving slot formed on a top wall of the affixing body, wherein the first rear receiving slot comprises a second receiving opening formed on a second front edge of the top wall.

In another aspect combinable with the general implementation, the rear receiving slot comprises a first rear receiving slot formed on a top wall of the affixing body, wherein the first rear receiving slot downwardly extends to form a second rear receiving slot, wherein the second rear receiving slot has an L-shaped configuration.

In another aspect combinable with the general implementation, the affixing body comprises a top wall and a bottom wall, wherein the top wall comprises a first front edge and a first rear edge, wherein the first front edge is formed on an opposite side of the first rear edge.

In another aspect combinable with the general implementation, the affixing body comprises a top wall and a bottom wall, wherein the bottom wall comprises a second front edge and a second rear edge, wherein the second front edge is formed on an opposite side of the second rear edge.

In another aspect combinable with the general implementation, the cord is inserted into the front receiving slot and the rear receiving slot to secure the cord on the affixing body. In another aspect combinable with the general implementation, the rotatable shaft comprises a controlling through hole, wherein the cord is passed through the controlling through hole.

In another aspect combinable with the general implementation, the cord surrounds the rotatable shaft while the rotatable shaft is rotated along the affixing body.

In another aspect combinable with the general implementation, the front receiving slot comprises a first front receiving slot formed on a bottom wall of the affixing body and a second front receiving slot integrally extends from the first front receiving slot to form on a front wall, wherein the second front receiving slot is frontward extended to form an L-shaped configuration.

In another aspect combinable with the general implementation, the rear receiving slot comprises a first rear receiving slot formed on a top wall of the affixing body and a second rear receiving slot integrally extends from the first rear receiving slot to form on a rear wall, the second rear receiving slot is backwardly extended to form an L-shaped configuration.

In another aspect combinable with the general implementation, the front receiving slot comprises a first front receiving slot and a second front receiving slot, wherein the second front receiving slot has an upwardly extended second front receiving slot upwardly extended from the first front receiving slot and a frontward extended second front receiving slot frontward extended from the upwardly extended second front receiving slot.

In another aspect combinable with the general implementation, the rear receiving slot comprises a first rear receiving slot and a second rear receiving slot, wherein the second rear receiving slot has a downwardly extended second rear receiving slot downwardly extended from the first rear receiving slot and a backwardly extended second rear receiving slot backwardly extended from the downwardly extended second rear receiving slot.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be too precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112 (f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

Figure 1:
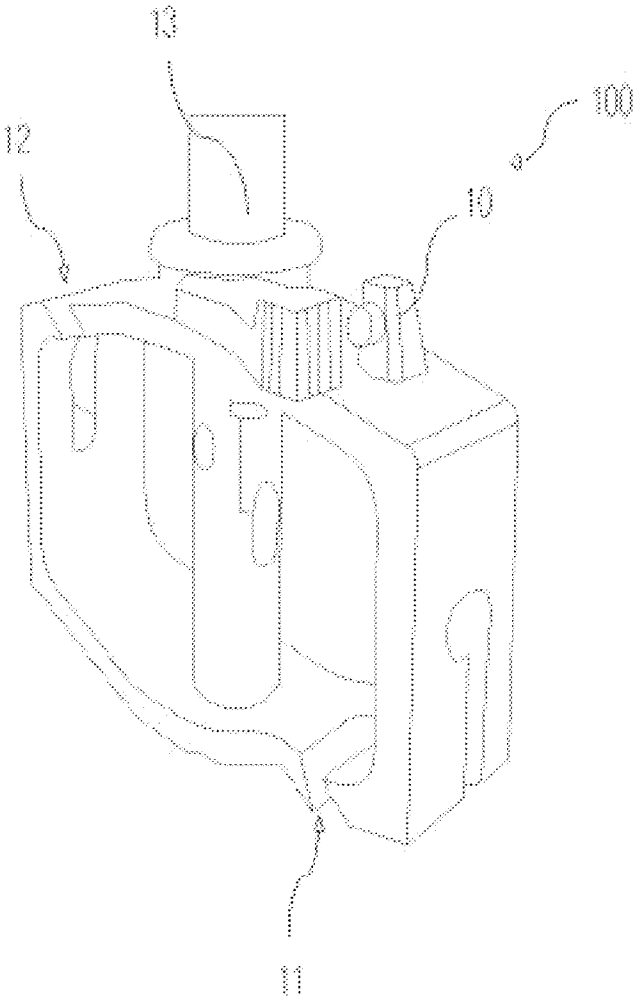
FIG. 1 is a perspective view of an adjustable assembly for a cover according to an aspect of the embodiment.
Figure 2:
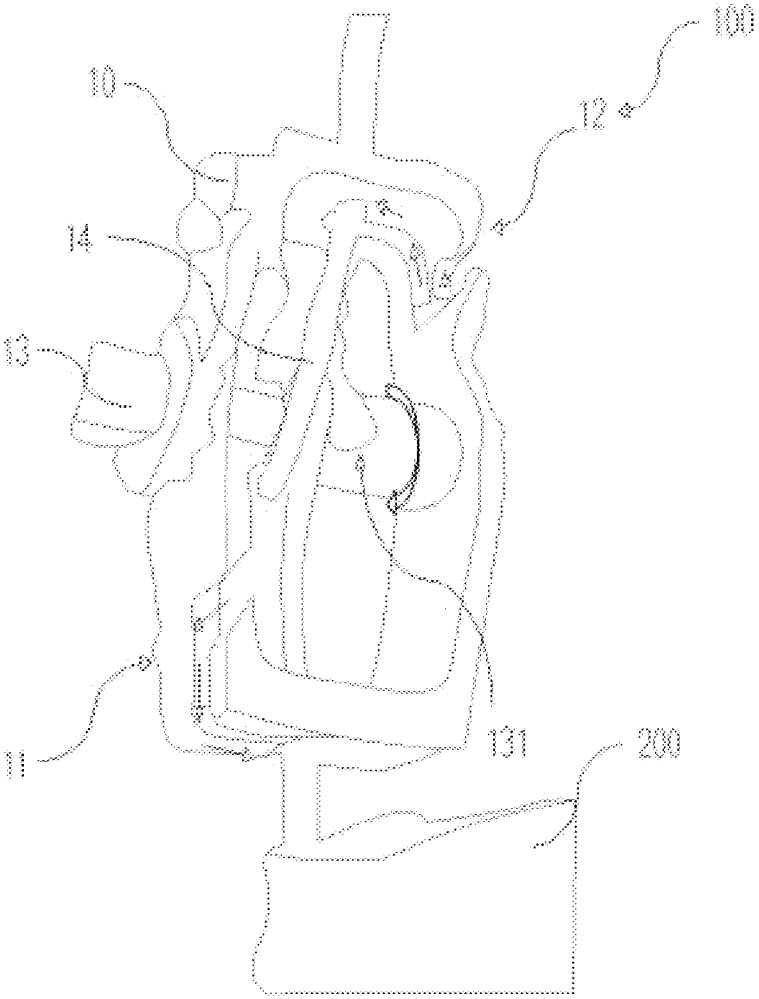
FIG. 2 is a side view of the adjustable assembly for the cover, showing a cord being cooperated with an affixing body according to an aspect of the embodiment.

FIGS. 1-2 generally depict a cord adjusting assembly 100 for a cover 200 according to an aspect of the embodiment.

Referring to FIG. 1, the cord adjusting assembly 100 may comprise an affixing body 10 having a front receiving slot 11 and a rear receiving slot 12. In some embodiments, the cord adjusting assembly 100 may further comprise a rotatable shaft 13 coupled to the affixing body 10.

Referring to FIG. 2, in some embodiments, the cord adjusting assembly 100 may further comprise a cord 14 attached to the cover 200, wherein the cord 14 may cooperate with the front receiving slot 11, the rear receiving slot 12, and the rotatable shaft 13 to tighten or loosen the cord 14 selectively.

In some embodiments, the rotatable shaft 13 may comprise a controlling through hole 131, wherein the cord 14 may be passed through the controlling through hole 131, wherein the cord 14 may be received inside the front receiving slot 11 and the rear receiving slot 12 to secure the cord 14 coupling to the affixing body 10.

In still some embodiments, the rotatable shaft 13 may be rotated along the affixing body 10 and may be disposed inside and passed through the controlling through hole 131, and in such a situation, the cord 14 may surround the rotatable shaft 13 to tighten the cord 14.

Figure 3:
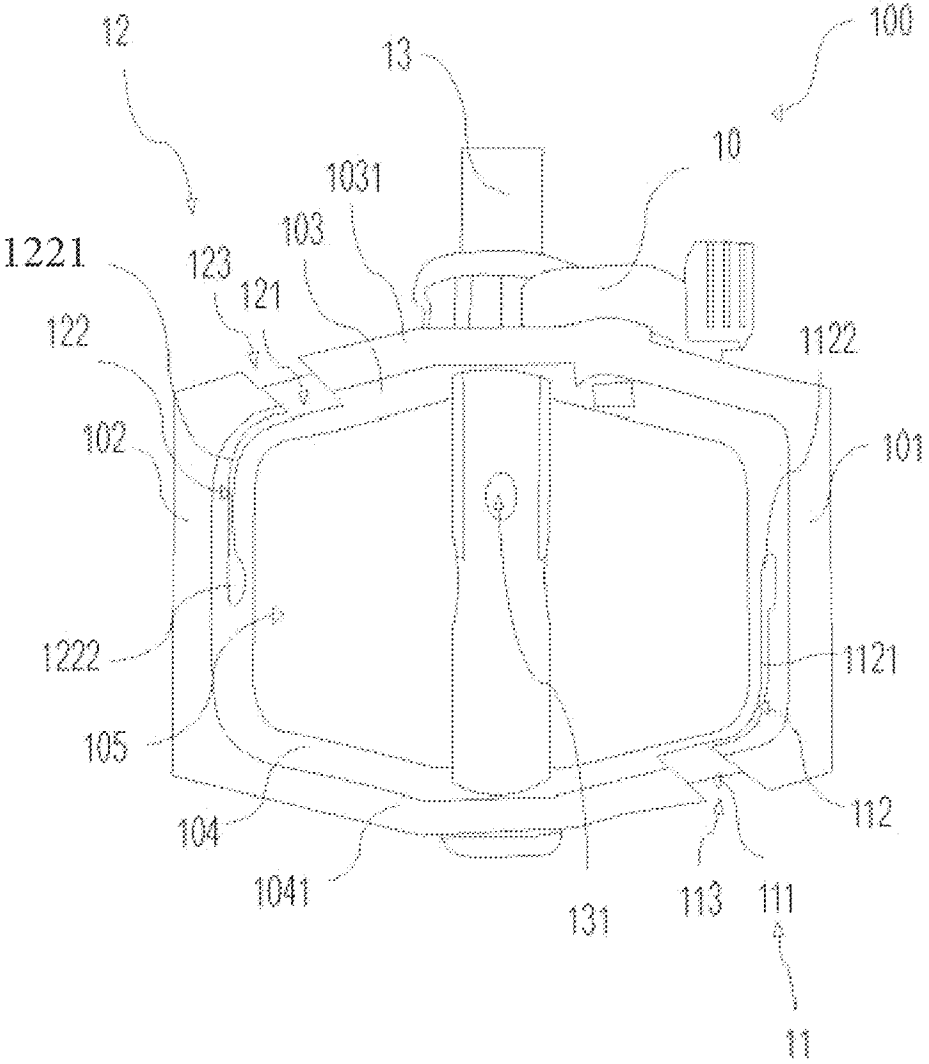
FIG. 3 is an opposite side view of the adjustable assembly for the cover of FIG. 2, showing a cord cooperating with an affixing body according to an aspect of the embodiment.
Figure 4:
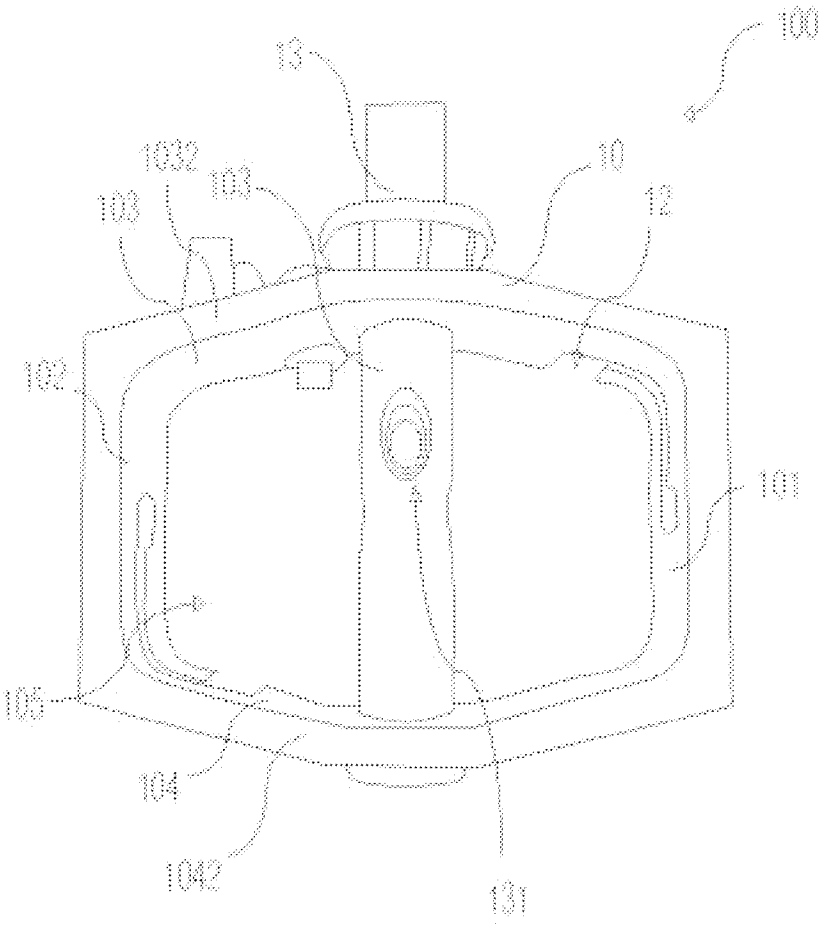
FIG. 4 is a sectional view of the affixing body according to an aspect of the embodiment.

FIGS. 3-4 generally depict the cord adjusting assembly 100 for the cover according to an aspect of the embodiment.

Referring to FIG. 3, in some embodiments, the affixing body 10 may comprise a front wall 101 and a rear wall 102 located on the opposite side of the front wall 101, wherein the front receiving slot 11 may be formed on the front wall 101, and the rear receiving slot 12 may be formed on the rear wall 102.

In some embodiments, as shown in FIG. 3, the affixing body 10 may comprise a top wall 103 and a bottom wall 104, wherein the top wall 103 may be formed on the opposite side of the bottom wall 104, wherein the top wall 103 may be integrally extended to form the front wall 101 and the rear wall 102, wherein the bottom wall 104 may be integrally extended to from the front wall 101 and the rear wall 102, and in such a manner, a receiving cavity 105 may be formed by the top wall 103, the bottom wall 104, the front wall 101, and the rear wall 102, wherein the rotatable shaft 13 may be passed through and rotated along the top wall 103 and the bottom wall 104, and disposed inside the receiving cavity 105.

In still some embodiments, the front receiving slot 11 may comprise a first front receiving slot 111 formed on the bottom wall 104 of the affixing body 10 and a second front receiving slot 112 integrally extends from the first front receiving slot 111 to form on the front wall 101.

In still some embodiments, the front receiving slot 11 may comprise the first front receiving slot 111 formed on the bottom wall 104 of the affixing body 10, wherein the first front receiving slot 111 may be an L-shaped configuration.

In still some embodiments, the front receiving slot 11 may comprise the first front receiving slot 111 formed on the bottom wall 104 of the affixing body 10, wherein the first front receiving slot 11 may comprise a first receiving opening 113 formed on a first front edge 1041 of the bottom wall 104.

In still some embodiments, as shown in FIGS. 3-4, the bottom wall 104 may comprise a first front edge 1041 and a first rear edge 1042, wherein the first front edge 1041 is formed on the opposite side of the first rear edge 1042. For example, the first front edge 1041 may parallel the first rear edge 1042.

Referring back to FIGS. 3-4, the rear receiving slot 12 comprises a first rear receiving slot 121 formed on the top wall 103 of the affixing body 10, and a second rear receiving slot 122 integrally extends from the first rear receiving slot 121 to form on the rear wall 102.

In some embodiments, the rear receiving slot 12 may comprise the first rear receiving slot 121 formed on the top wall 103 of the affixing body 10, wherein the rear receiving slot 12 comprises a second receiving opening 123 formed on a second front edge 1031 of the top wall 103. In still some embodiments, the top wall 103 may comprise the second front edge 1031 and a second rear edge 1032, wherein the second front edge 1031 may be opposite of the second rear edge 1032. For example, the second front edge 1031 may parallel the second rear edge 1032.

In some embodiments, the front receiving slot 11 comprises the first front receiving slot 111 formed on the bottom wall 104 of the affixing body 10, wherein the first front receiving slot 111 may be upwardly extended to form the second front receiving slot 112, wherein the second front receiving slot 112 has an L-shaped configuration.

In some embodiments, the rear receiving slot 12 may comprise the first rear receiving slot 121 formed on the top wall 103 of the affixing body 10, wherein the first rear receiving slot 121 may be downwardly extended to form the second rear receiving slot 122, wherein the second rear receiving slot 122 has an L-shaped configuration.

In still some embodiments, the front receiving slot 11 may comprise the first front receiving slot 111 formed on the bottom wall 103 of the affixing body 10, and the second front receiving slot 112 integrally extends from the first front receiving slot 111 to form on the front wall 101.

In still some embodiments, the rear receiving slot 12 may comprise the first rear receiving slot 121 formed on the top wall 103 of the affixing body 10, and the second rear receiving slot 122 integrally extends from the first rear receiving slot 121 to form on the rear wall 102.

It should be noted that the frontward direction is the opposite of the backward direction.

Continuing to FIG. 3, in some embodiments, the front receiving slot 11 may comprise the first front receiving slot 111 and the second front receiving slot 112, wherein the second front receiving slot 112 has an upwardly extended second front receiving slot 1121 upwardly extended from the first front receiving slot 111 and a frontward extended second front receiving slot 1122 frontward extended from the upwardly extended second front receiving slot 1121, and in such a manner, the second front receiving slot 112 is an L-shaped configuration.

As shown in further detail in FIG. 3, the rear receiving slot 12 may comprise the first rear receiving slot 121 and the second rear receiving slot 122, wherein the second rear receiving slot 122 may comprise a downwardly extended second rear receiving slot 1221 downwardly extended from the first rear receiving slot 121 and a backwardly extended second rear receiving slot 1222 backwardly extended from the downwardly extended second rear receiving 1221 to form an L-shaped configuration.

It should be noted that, according to all of the above embodiments, the downward direction is the opposite of the upward direction.

Turning now to FIG. 2 and FIG. 3, the cord 14 may be inserted into the front receiving slot 11 and the rear receiving slot 12 to secure the cord 14 on the affixing body 10.

In some embodiments, the cord 14 may be passed through the first receiving opening 113 formed on the first front edge 1041 of the bottom wall 104 and inserted into the first front receiving slot 111, and in such a manner, the cord 14 may be moved along the first front receiving slot 111 of the front receiving slot 11 and the upwardly extended second front receiving slot 1121 of the second front receiving slot 112 to be received inside the backwardly extended second front receiving slot 1122.

In some embodiments, the cord 14 may be passed through the second receiving opening 123 formed on the second front edge 1031 of the top wall 103, and in such a manner, the cord 14 may be inserted into the first rear receiving slot 121 and moved downwardly along the downwardly extended second rear receiving slot 1221 of the second rear receiving slot 122 and moved along the backwardly extended second rear receiving slot 1222 of the second rear receiving slot 122 to be received therein.

As shown in further detail in FIG. 2, the cord 14 may surround the rotatable shaft 13 while the rotatable shaft 13 is rotated along the affixing body 10. It should be noted that, in some embodiments, after the cord 14 is inserted into the front receiving slot 11 and the rear receiving slot 12, the rotatable shaft 13 may be rotated, and in such a way, the cord 14 may be surrounded on the rotatable shaft 13 to tighten the cord 14.

Figure 5:
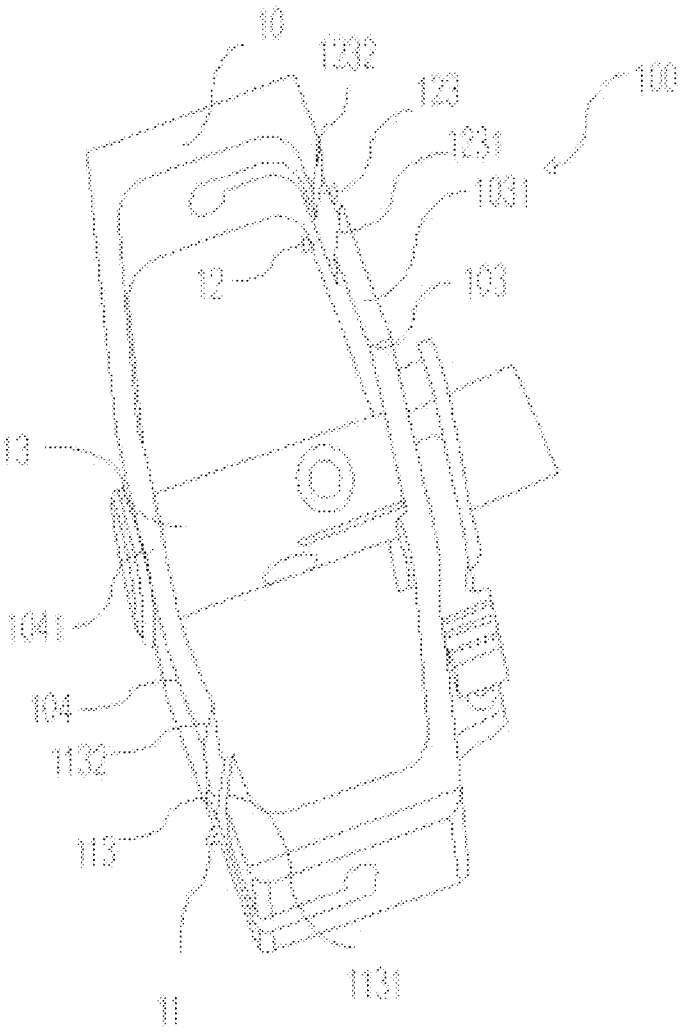
FIG. 5 shows another side view of the affixing body according to an aspect of the embodiment.

FIG. 5 generally depicts the first receiving opening 113 and the second receiving opening 123 of the cord adjusting assembly 10 according to an aspect of the embodiment.

With specific reference to FIG. 5, the first receiving opening 113 may be inclinedly formed on the first front edge 1041 of the bottom wall 104, and the second receiving opening 123 may be inclinedly formed on the second front edge 1031 of the top wall 103.

In some embodiments, the first receiving opening 113 may comprise a first front opening edge 1131 inclinedly formed on the first front edge 1041 of the bottom wall 104 and a first rear opening edge 1132 inclinedly formed on the first front edge 1041 of the bottom wall 104 of the affixing body 10, wherein the first front opening edge 1131 may be parallel to the first rear opening edge 1132.

In still another embodiments, the second receiving opening 123 may be inclinedly formed on the second front edge 1031 of the top wall 103 of the affixing body 10, wherein the second receiving opening 123 may comprise a second front opening edge 1231 inclinedly formed on the second front edge 1031 of the top wall 103 of the affixing body 10 and a second rear opening edge 1232 inclinedly formed on the second front edge 1032 of the top wall 103 of the affixing body 10, wherein the second front opening edge 1231 may be parallel to the second rear opening edge 1232.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

Thus, specific embodiments and applications of the cord adjusting assembly for the cover have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A cord adjusting assembly for a cover comprising:

an affixing body comprising a front receiving slot and a rear receiving slot;

a rotatable shaft rotatably coupled to the affixing body;

a cord attached to the cover; wherein the front receiving slot, the rear receiving slot, and the rotatable shaft are cooperated with the cord to tighten or loosen the cord-; wherein the affixing body is a one-piece construction and comprises a front wall, a rear wall located on an opposite side of the front wall, a bottom wall integrally extended from the front wall and the rear wall, a top wall integrally extended along the front wall and the rear wall to the bottom wall; wherein the rotatable shaft is passed through the top wall and the bottom wall;

the affixing body comprises a distal peripheral free edge forwardly extended and terminating in a proximal peripheral free edge to form the front wall, the rear wall, the bottom wall, and the top wall; wherein the front receiving slot is integrally extended from the bottom wall to the front wall, and the rear receiving slot is integrally extended from the top wall to the rear wall; wherein the bottom wall comprises a first front edge and a first rear edge formed on an opposite side of the first front edge, and the top wall comprises a second front edge and a second rear edge formed on an opposite side of the second front edge, wherein the first front edge is integrally extended along the front wall and the rear wall to the second front edge;

while the rotatable shaft is rotated along the affixing body and the cord surrounds the rotatable shaft, the first receiving slot and the second receiving slot are two isolated slots without communicating with each other;

wherein the rotatable shaft comprises a controlling through hole transversely extended through the rotatable shaft to form a circle hole.

2. The cord adjusting assembly of claim 1, wherein the rotatable shaft is rotated along the top wall and the bottom wall.

3. The cord adjusting assembly of claim 1, wherein the front receiving slot comprises a first front receiving slot formed on the bottom wall of the affixing body and a second front receiving slot formed on the front wall and integrally extends from the first front receiving slot.

4. The cord adjusting assembly of claim 1, wherein the rear receiving slot comprises a first rear receiving slot formed on the top wall of the affixing body and a second rear receiving slot formed on the rear wall and integrally extends from the first rear receiving slot.

5. The cord adjusting assembly of claim 1, wherein the front receiving slot comprises a first front receiving slot formed on the bottom wall of the affixing body, wherein the first front receiving slot is backwardly extended from a first receiving opening and upwardly extended to form a second front receiving slot.

6. The cord adjusting assembly of claim 1, wherein the front receiving slot comprises a first front receiving slot formed on the bottom wall of the affixing body, wherein the first front receiving slot comprises a first receiving opening formed on the first front edge of the bottom wall.

7. The cord adjusting assembly of claim 1, wherein the front receiving slot comprises a first front receiving slot formed on the bottom wall of the affixing body, wherein the first front receiving slot is upwardly extended to form a second front receiving slot, wherein the second front receiving slot has an L-shaped configuration.

8. The cord adjusting assembly of claim 1, wherein the rear receiving slot comprises a first rear receiving slot formed on the top wall of the affixing body, wherein the first rear receiving slot comprises a second receiving opening formed on a second front edge of the top wall.

9. The cord adjusting assembly of claim 1, wherein the rear receiving slot comprises a first rear receiving slot formed on the top wall of the affixing body, wherein the first rear receiving slot is downwardly extended to form a second rear receiving slot, wherein the second rear receiving slot has an L-shaped configuration.

10. The cord adjusting assembly of claim 1, wherein the cord is inserted into the front receiving slot and the rear receiving slot to secure the cord on the affixing body.

11. The cord adjusting assembly of claim 1, wherein the cord is passed through the controlling through hole.

12. The cord adjusting assembly of claim 1, wherein the front receiving slot comprises a first receiving opening inclinedly formed on the first front edge of the bottom wall.

13. The cord adjusting assembly of claim 1, wherein the rear receiving slot comprises a second receiving opening inclinedly formed on the second front edge of the top wall.

14. The cord adjusting assembly of claim 1, wherein the front receiving slot comprises a first front receiving slot and a second front receiving slot, wherein the second front receiving slot has an upwardly extended second front receiving slot upwardly extended from the first front receiving slot and a frontward extended second front receiving slot frontward extended from the upwardly extended second front receiving slot.

15. The cord adjusting assembly of claim 1, wherein the rear receiving slot comprises a first rear receiving slot and a second rear receiving slot, wherein the second rear receiving slot has a downwardly extended second rear receiving slot downwardly extended from the first rear receiving slot and a backwardly extended second rear receiving slot backwardly extended from the downwardly extended second rear receiving slot.

* * * * *